United States Patent [19]

Saint-Remy Pellissier

[11] 3,964,298

[45] June 22, 1976

[54] APPARATUS FOR MEASURING PENETRATION OF TUBES OF A PENETROMETER

[75] Inventor: Charles Marc Marie Saint-Remy Pellissier, Avignon, France

[73] Assignee: Societe Anonyme Fondasol-Technique, Avignon, France

[22] Filed: Aug. 4, 1975

[21] Appl. No.: 601,447

[30] Foreign Application Priority Data

Aug. 2, 1974 France ..... 74.27657

[52] U.S. Cl. ..... 73/84

[51] Int. Cl.[2] ..... G01N 3/42

[58] Field of Search ..... 73/81, 82, 84

[56] References Cited

UNITED STATES PATENTS

| | | | |
|---|---|---|---|
| 2,580,299 | 12/1951 | Hunicke | 73/84 |
| 2,607,218 | 8/1952 | Hansen | 73/84 |
| 3,498,388 | 3/1970 | Jovis | 73/82 X |

*Primary Examiner*—Jerry W. Myracle
*Attorney, Agent, or Firm*—Karl F. Ross; Herbert Dubno

[57] ABSTRACT

A housing adjacent the anvil of a penetrometer has a pair of parallel upright guides on one of which is slideable a first counterweight and on the other of which slides a second counterweight and a slide underneath this second counterweight. The first counterweight weighs more than the slide but less than the slide and second counterweight together. A chain passes over a sprocket at the top of the housing and has one end secured to the first counterweight and another end to the slide. An abutment on the second counterweight engages over a follower on the anvil so that as the anvil goes up and down the second counterweight follows it. During normal descent of the anvil and second counterweight a ratchet engaging the wheel prevents return rotation of this wheel, but once the second counterweight is all the way at the bottom of its guide the ratchet is pulled back. Upward movement of this second counterweight from this position through a distance equal to one tube length reactuates the ratchet. A recorder is connected through a unidirectional clutch with the shaft of the wheel so as only to respond to rotation of this wheel corresponding to downward driving of a tube.

10 Claims, 5 Drawing Figures

APPARATUS FOR MEASURING PENETRATION OF TUBES OF A PENETROMETER

CROSS-REFERENCE TO RELATED APPLICATIONS

This application is related to my copending patent applications Ser. No. 543,951 and Ser. No. 543,953 both filed 24 Jan. 1975.

FIELD OF THE INVENTION

The present invention relates to an apparatus for measuring and recording the penetration of the tubes of a penetrometer.

BACKGROUND OF THE INVENTION

A penetrometer is an apparatus used for exploring the ground driving a probe placed at the lower end of a set or string of tubes into the ground. The measurements which may be carried out by means of the penetrometer are in particular the displacement of the probe, i.e. the penetration depth of the tubes, the resistance exerted on the point of the probe, on its lateral surface, and on the entire set of tubes.

These measurements are normally undertaken during static operation of the apparatus, which consists of exerting considerable pressure on the top of the set of tubes, by a powerful hydraulic ram. When it is necessary to drive the tubes into very hard ground, penetration of the probe is achieved by means of a pile driver. This operation is termed dynamic and when it is being carried out it is necessary to stop making measurements of resistance.

In case of both static and dynamic operation it is important to know exactly the penetration of the tubes at any instant. During static operation measurement of the various forces exerted on the probe and on the entire set of tubes is significant only if it is related to the depth to which the probe is driven. During dynamic operation, it is customary to count the number of hammer blows necessary to obtain a given penetration.

At present the means used for measuring the penetration of the tube is rudimentary: the tubes are counted and the length of tubes driven in is measured directly by marking with chalk, for example every 10 centimeters. A slightly more sophisticated system described in French Pat. No. 1,077,660 of 27 Mar. 1953 to Marius ANDINA and Gaston BAUER, provides a fixed graduated rule arranged vertically, along which moves a pointer supported by the head containing the measuring apparatus, which itself is disposed at the top of the set of tubes. This device makes it possible to follow the penetration of the probe into the ground, however it has two main drawbacks. First of all it does not indicate the total penetration from the beginning of the test, but only shows partial penetrations which must be added, thus involving the risk of error. Secondly it does not facilitate recording of the penetration.

At the present time no automatic apparatus exists for measuring and recording the penetration of the tubes without manual intervention and the risk of error. An apparatus of this type would be very advantageous since, with currently available electronic means for processing the information, it would make it possible to record and possibly simultaneously to print out the value of the forces during static operation or the number of hammer blows during dynamic operation and the corresponding depth of the probe.

To provide an apparatus of this type, it is not sufficient directly to measure the descent of the anvil. Indeed, it may happen that it is necessary to raise the anvil during the tests, without adding tubes, for example subsequent to an incorrect movement or for handling requirements. The anvil must then be relowered without this corresponding to driving-in of the tubes, so that simple measurement of the total descent of the anvil no longer corresponds to the penetration of the tubes.

Measurement of the descent of the head containing the measuring apparatus would possibly eliminate this drawback during static operation. However, this solution must be disregarded since during dynamic operation, the aforesaid head is withdrawn.

It thus appears necessary to measure and record the descent of the anvil and not of the head containing the measuring apparatus, by a device which adds solely the useful movements of the anvil, i.e. those during which the anvil drives the set of tubes and which disregards parasitic movements resulting from incorrect operation or movements for releasing the anvil carried out solely for handling reasons.

OBJECTS OF THE INVENTION

It is therefore an object of the present invention to provide an improved apparatus for measuring the penetration of the tube string of a penetrometer.

Another object is the provision of such a device which only measures anvil displacement during actual driving of the tube string, but which ignores any other movements of the anvil.

A further object is to provide such an apparatus that is simple to operate and inexpensive to manufacture.

SUMMARY OF THE INVENTION

The objects are attained according to the present invention in an arrangement having a chain passing over a wheel or pinion rotatable in a housing about a horizontal axis. A first counterweight riding on a first guide is secured to one end of a chain and a second counterweight is vertically slidable on another guide and may rest on a slide movable along that other guide and connected to the other end of the chain. The combined weight of the slide and the second counterweight is greater than that of the first counterweight, while the slide alone is lighter than the first counterweight. An abutment or index is provided on the second counterweight and is positioned to lie above and be engageable with a finger member on the anvil so that this anvil may lift the second counterweight. Means including a ratchet is connected to the wheel or pinion over which the chain passes, the ratchet being controlled by means able to allow rotation in the direction corresponding to raising the slide only if the latter has just reached its lower position and until it has reascended, driven by the first counterweight through a vertical distance equal to the length of one tube. A free wheel able to transmit to an output shaft obly the rotation of the pinion in a direction corresponding to descent of the slide is connected to adding and recording means controlled by the aforesaid output shaft.

According to this invention the means for controlling the ratchet comprise a pivotal member having two stable toggle positions, connected to the ratchet and disposed in the trajectory or path of the two control finger members disposed one on the first counterweight and the other on the second counterweight, the finger members controlling the reversal of position of the aforesaid pivotal member when the first counterweight or slide reaches the upper position.

According to another feature of this invention the ratchet and the pivotal member each with two stable positions ensuring its control are mounted to pivot about the same horizontal pivot and are interconnected by a first spring, whereas a second spring, attached to the pivotal part at the same point as the first, connects the latter to a fixed horizontal pivot also constituting an abutment for said member, in order to keep it in a stable position while allowing displacement into the other stable position.

When the anvil descends, driving the set of tubes, the arrangement formed by the second counterweight and the slide descends following the anvil and entraining the chain which causes the first counterweight to rise and the output shaft to rotate, provided that the free wheel is driven in the coupling direction. If for any reason the anvil rises before having reached its lower position, it pulls the second counterweight upward. The first counterweight would descend but for the action of the ratchet which locks the arrangement formed by the chain, the first counterweight, and the slide immobile and the entire measuring and recording apparatus waits in its intermediate position. When the anvil redescends, the second counterweight comes back into contact with the slide, in the position in which it left the latter and measurement is resumed normally from the point where it was interrupted.

When the anvil reaches its lower position, the first counterweight arrives in the upper position and its control finger member causes the reversal of position of the pivotal part which in turn moves the ratchet, putting the latter out of operation. At the time of reascent of the anvil, the two counterweights and the slide move, the movements of the chain no longer being prevented by the ratchet. The free wheel thus fulfils its function, which is to prevent the output shaft from being driven backward.

When the second counterweight reaches the upper position, after a travel equal to the length of one tube, its control finger member causes the reversal of position of the pivotal part, which in turn moves the ratchet, bringing the latter back into operation. The chain is thus immobilized and after positioning a new length of tube, the apparatus is ready to measure and record the subsequent penetration.

According to another feature of the invention, the vertical guide for the second counterweight is extended above the level of the pinion over which the chain passes and means is provided to ensure locking of the second counterweight in the upper position. This placing of the second counterweight in a parking position makes it possible to neutralize the measuring device when desired, for example at the time of a stoppage during penetration or for repairs.

The adding and recording means controlled by the output shaft, for example through the intermediary of a bowden cable advantageously comprise a coding wheel facilitating transcription of the measurement into the binary coded decimal system (BCD). According to any advantageous embodiment, an electric motor is provided capable of driving the transmission cable and coding wheel in the direction facilitated by the free wheel for resetting the depth indication to zero, for a new test.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
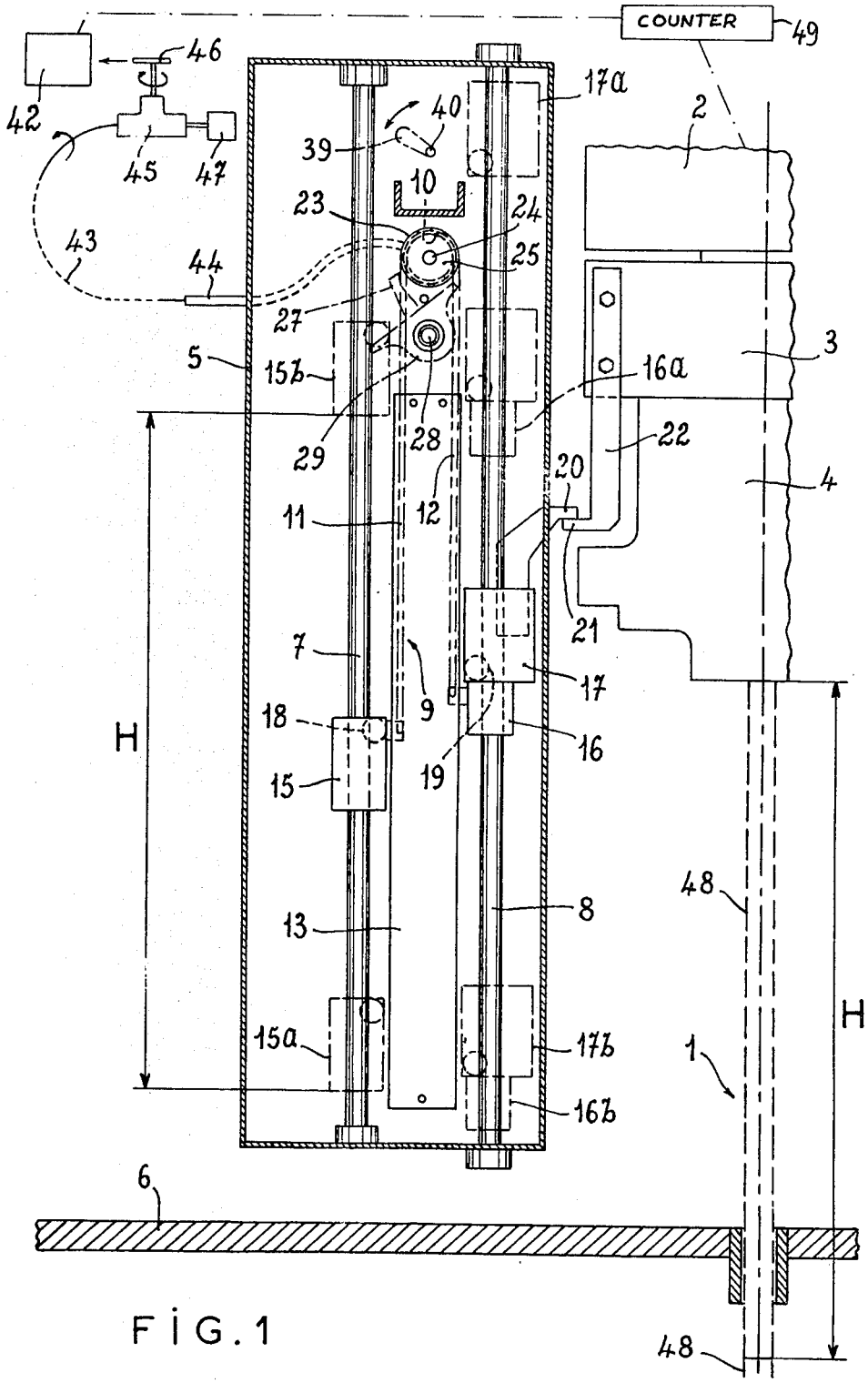
FIG. 1 is a side view partly in section through the apparatus according to the present invention.

FIG. 1 shows partially and very diagrammatically a penetrometer making it possible to drive a set of tubes 1 into the ground, such as that described in my above-cited U.S. patent application Ser. No. 543,951 of 24 Jan. 1975. Dynamic penetration takes place in known manner by means of a driving hammer 2 striking an anvil 3, the hammer and anvil being guided vertically in the uprights of a frame (not shown) which may be inclined, such as that described in my other above-cited U.S. patent application Ser. No. 543,953 of 24 Jan. 1975. A measuring head 4 is interposed between the anvil 3 and the top of the set of tubes 1 for measuring, during static operation, the resistance exerted on the point of the probe, on its lateral surface and on the entire set of tubes 1.

The apparatus according to the invention is housed inside a casing 5, accessible from the platform 6, but is not mounted on the latter, but on the inclinable frame.

Figure 2:
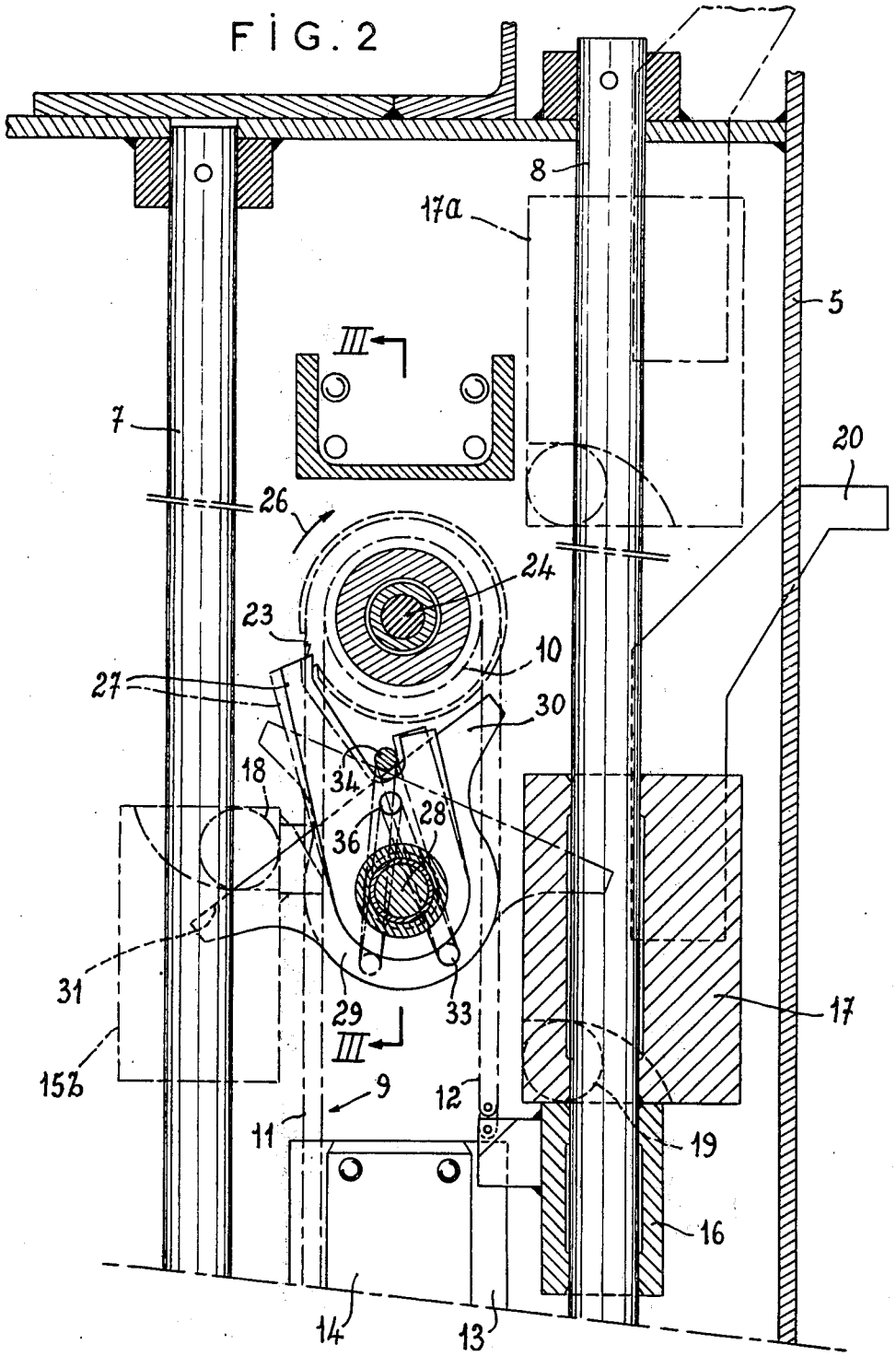
FIG. 2 is a vertical section in enlarged scale through a detail of the apparatus of FIG. 1.

Two vertical guide pillars or posts 7 and 8 are secured in the base and the top of the casing 5. Disposed between these two pillars is a chain 9 passing over a sprocket or pinion 10 having a horizontal axis. The chain forms two vertical sides or stretches 11 and 12 guided between two plates 13. As shown in FIG. 2, a third plate 14 of lesser width may be interposed between the two plates 13.

A first counterweight 15, slidable mounted on the vertical pillar 7, is fixed to the end of the first side 11 of the chain 9. A slide 16, mounted on the vertical pillar 8 is fixed to the end of the second side 12 of the chain 9. A second counterweight 17 is also slidably mounted on the pillar 8, above the slide 16. The first counterweight 15 and the second counterweight 17 each support a control finger member, respectively 18 and 19, the function of which will become apparent hereafter.

The second counterweight 17 also supports an outrigger or index 20 projecting outside the casing 5 through a vertical slot. The index 20 is able to abut above the bent end 21 of a finger member 22 fixed to the anvil 3.

To facilitate the operation of the apparatus, it is necessary that:

1. The weight of the slide 16 be less than that of the first counterweight 15, and 2. The weight of the arrangement formed by the slide 16 and second counterweight 17 be greater than that of the first counterweight 15.

Furthermore, the differences in weight must be sufficient to overcome the inertia of the mechanism.

Figure 3:
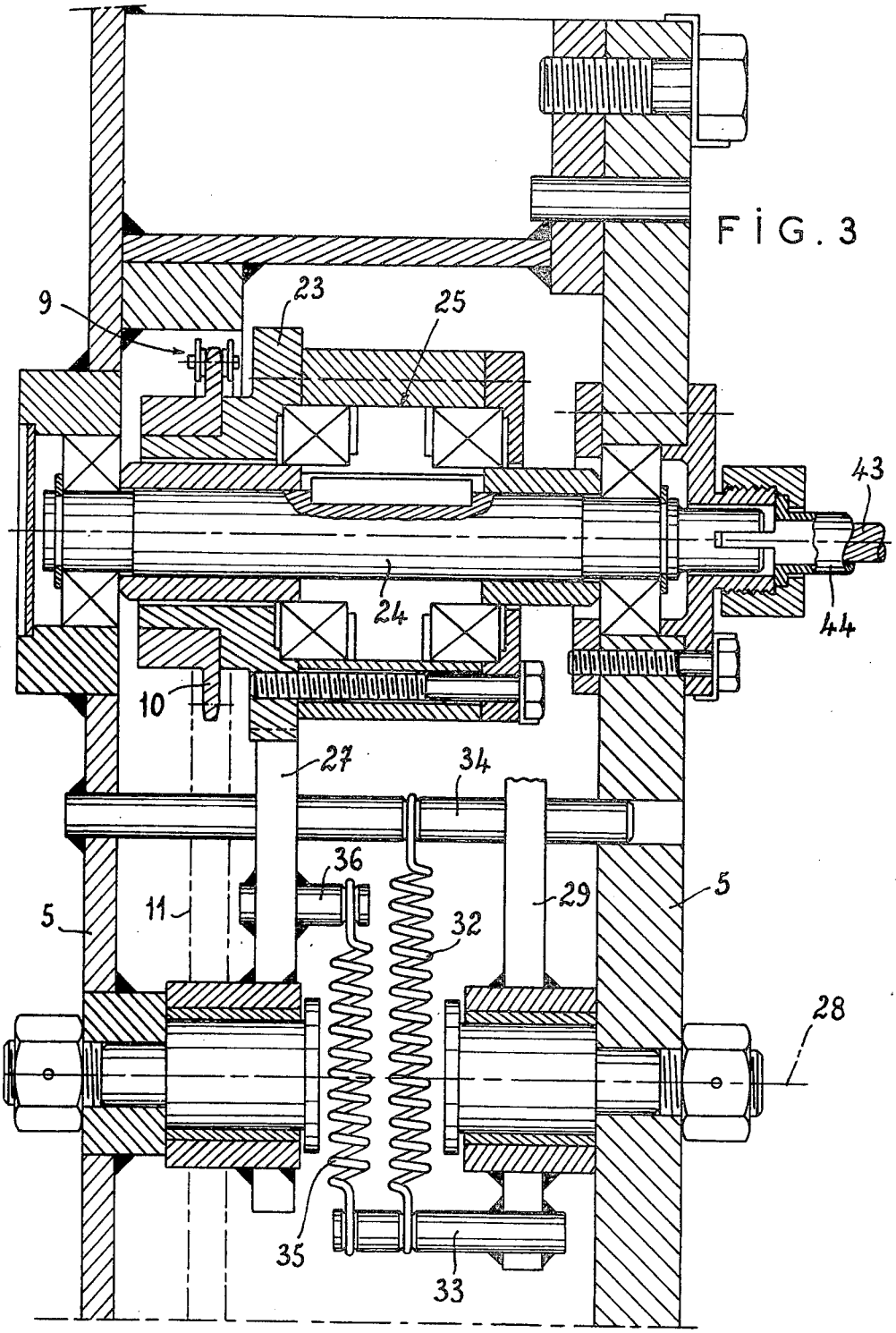
FIG. 3 is a section taken along line III—III of FIG. 2.

As shown in FIGS. 2 and 3, the pinion 10, over which the chain 9 passes rotates jointly with a ratchet wheel 23, which is in turn coupled to an output shaft 24 through the intermediary of a unidirectional clutch or free wheel 25. The latter ensures the drive of the shaft 24 solely in the direction indicated by an arrow 26 in FIG. 2, i.e. in the direction corresponding to descent of the slide 16.

A ratchet pawl 27 engageable with the teeth of the ratchet wheel 23 is mounted to pivot about a horizontal pivot 28 located under the shaft 24. This ratchet may occupy two positions both indicated in FIG. 2:

1. In the position shown in solid lines, the ratchet 27 engages between the teeth of the wheel 23 in order to allow rotation in the direction of arrow 26 and prevent rotation in the opposite direction, 2. In the position shown in dot-dash lines, the ratchet 27 is pulled away from the wheel 23 and is out of operation.

The ratchet pawl 27 is controlled by means of a pivotal member 29, able to rotate about the same pivot 28 as the ratchet and linked to the ratchet to move it between the two positions previously mentioned. The member 29 has two arms 30 and 31 extending into the vertical paths of the two control finger members 18 and 19 supported by the counterweights 15 and 17 and functioning to control the reversal of position of the pivotal member 29.

The member 29 is in fact arranged to have two stable positions corresponding to the two positions of the ratchet 27. A spring 32, attached to the member 29 on a small shaft 33, connects the latter to a fixed horizontal shaft 34. A spring 35, also attached to the member 29 on the shaft 33, connects it to a small shaft 36 integral with a ratchet 27. The two stable positions of the pivotal member 29 are indicated in FIG. 2, one in solid line; the other in dot-dash lines and correspond respectively to the positions of the ratchet 27 shown in solid lines and dot-dash lines. As may be seen from this figure, it is the shaft 34 which serves as an aubtment for the member 29 in its two extreme stable positions.

Figure 4:
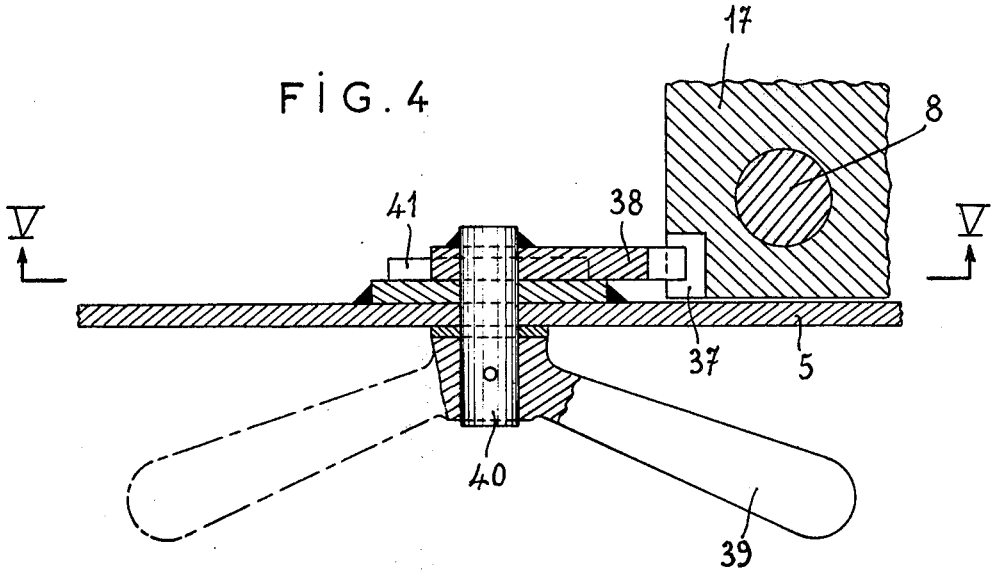
FIG. 4 is a horizontal section through the device for locking the second counterweight in the upper position.
Figure 5:
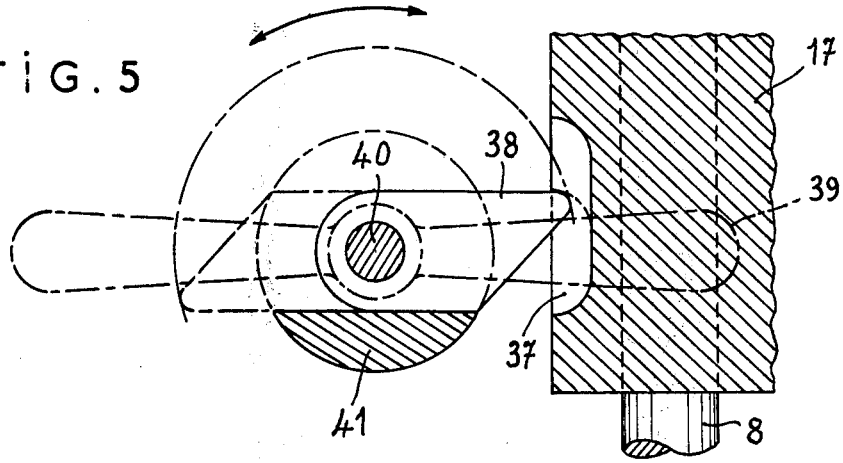
FIG. 5 is a section taken along line V—V of FIG. 4.

The vertical pillar 8 extends above the level of the pinion 10 and this extension provides sufficient space for placing the second counterweight 17 in the parking position indicated by the reference 17*a*, above the mechanism comprising the pinion 10, ratchet 27, pivotal member 29 etc. As shown particularly in FIGS. 4 and 5 the counterweight 17 is formed on one of its sides with a notch 37, in which may be engaged a finger member 38 pivotally mounted about a horizontal pivot and connected to rotate jointly with a control handle 39 by means of a shaft 40 passing through the casing 5. A projecting part 41 on the member 38 formes an abutment for the two extreme positions of the finger member 38: the position shown in solid lines facilitates locking of the counterweight 17, whereas the position shown in dot-dash lines makes this device inoperative.

Recording the measurement takes place outside the casing 5, in an electronic display 42 in FIG. 1. The connection to this display is produced by means of a transmission cable 43, able to rotate in a sheath 44, which is coupled to a bevel gear 45 having two inputs. Mounted at the output of the bevel gear 45, which may also fulfil the function of reducing means is a coding wheel 46 facilitating transcription of the measurement into a binary coded decimal.

The second input of the bevel gear 45 is connected to an electric motor 47 used solely for resetting the depth indication to zero, an operation which is necessary before carrying out a new test. This motor simultaneously drives the transmission cable 43 and the coding wheel 46 and it therefore has the same direction of rotation as the free wheel 25.

The operation of the device is cyclic, each cycle corresponding to the addition of one length of tube to the set of tubes 1. In FIG. 1, the reference 48 designates a tube outside the set of tubes and H represents its height, equal to one meter for example.

Assuming that at the beginning the anvil 3 occupies an intermediate position, for example that shown in FIG. 1 and is in the course of descending, driving in the set of tubes 1, it is possible to make the following observations:

1. The pivotal member 29 and the ratchet 27 which it controls occupy the position shown in solid lines in FIG. 2, such that the chain 9 and the pinion 10 may move only in the direction of arrow 26, prevented by the ratchet 27 from moving in the opposite direction, 2. As the anvil 3 descends the second counterweight 17 and the slide 16 follow. The chain 9 moves, rotating the pinion 10 and causing the first counterweight 15 to ascend. All the parts have identical displacements due to the fact that the arrangement formed by the slide 16 and the second counterweight 17 is heavier than the first counterweight 15, which is in turn heavier than the slide 16 alone, 3. The free wheel 25 is driven in the direction of arrow 26, which is the coupling direction, it thus rotates the output shaft 24, the transmission cable 43 and the coding wheel 46. The penetration of the set of tubes 1 is thus measured and recorded.

When the anvil reaches its lower position, the same is true of the slide 16 and the counterweight 17, whose end-of-downward-travel positions are illustrated in dot-dash lines in FIG. 1 and designated by the reference numerals 16*b* and 17*b*. The counterweight 15 thus arrives in the upper position, illustrated in dot-dash line in FIGS. 1 and 2 and designated by the reference numeral 15*b*. The control finger member 18 of the counterweight 15 abuts against the arm 30 of the pivotal member 29 and causes the latter to tilt, which comes into the position shown in dot-dash line and removes the ratchet 27 from the wheel 23.

During reascent of the anvil 3, the finger member 22 moves the second counterweight 17 upward and the following observations may be made:

1. Since the ratchet 27 is out of operation, the chain 9 and pinion 10 may move in the opposite direction to that of arrow 26. Since the counterweight 15 is heavier than the slide 16, the former may descend, whereas the latter will ascend, following the large counterweight 15, 2. The free wheel 25 is driven in the direction opposite to that of arrow 26 and it therefore does not rotate the output shaft 24, transmission cable 43 and coding wheel 46. There is thus no rearward return in the measurement and the entire recording device removing in the position it had previously attained, showing the value obtained at the end of previous descent of the anvil 3.

When the control finger member 19 of the second counterweight 17 reaches the arm 31 of the pivotal member 29, it causes the latter to tilt into the position shown in solid lines in FIG. 2, which causes the engagement of the ratchet 27 with the teeth of the wheel 23. The chain 9 is thus immobilized, the slide 16 occupying its upper position 16*a* and the first counterweight 15 occupying its lower position 15*a*, shown in dot-dash lines in FIG. 1.

However, it should be noted that the arm 31 of the pivotal member 29 does not serve as an abutment for the finger member 19 and on the contrary, allows the second counterweight 17 to rise further, for example to its so-called parking position 17*a* (see FIG. 2).

After positioning a new length of tube, the apparatus is ready to measure and record the result of the penetration, as soon as the second counterweight 17 pushes the slide 16 downward during its descent.

Exactness of the measurement is guaranteed by the fact that the travel of the slide 16, between its lower position 16*b* and its upper position 16*a*, is equal to the height H of one tube 48, such that a forward and return movement of the slide 16 corresponds exactly to driving in one length of tube.

Moreover, measurement cannot be falsified by reascent of the anvil 3 which would take place before the latter reaches its lower position. In fact, if the anvil ascends, subsequent to faulty operation or a manoeuvre controlled voluntarily for operating reasons, for example for withdrawing the measuring head 4, it pulls the second counterweight 17 upward but, under the action of the ratchet 27, the arrangement formed by the chain 9, the first counterweight 15 and the slide 16 remain stationary. The entire measuring and recording device is in the waiting position, immobile, in its intermediate position. When the anvil 3 redescends, the second counterweight 17 once more comes into contact with the slide, in the position in which it left the latter and measurement is resumed normally from the point where it was interrupted.

This apparatus for measuring the penetration of tubes may be provided with a device 49 which, during dynamic operation, counts the number of blows carried out by the hammer 2, for example by means of an electrical contact disposed on the cylinders which cause the reascent of the hammer 2, by friction. Means for processing the information thus make it possible to count the number of blows necessary for given penetration.

Naturally, the invention is not limited to the single embodiment of this apparatus for measuring and recording the penetration of the tubes of a penetrometer. On the contrary, it includes all variations comprising equivalent means.

I claim:

1. An apparatus for measuring the penetration of the tubes driven in by the anvil of a penetrometer, said apparatus comprising:

a housing adjacent said penetrometer;

a wheel rotatable in said housing about a horizontal axis;

a chain reeved over said wheel and having an end hanging to each side of said wheel;

a pair of upright guides in said housing each adjacent a respective end of said chain;

a first counterweight secured to one end of said chain and slideable vertically along the respective guide;

a slide secured to the other end of said chain and slideable vertically along the respective guide, said slide weighing less than said first counterweight;

a second counterweight slideable along the guide of said slide above said slide, said second counterweight and said slide together weighing more than said first counterweight;

an abutment on said second counterweight engageable with said anvil on upward travel thereof, whereby lifting of said anvil lifts said second counterweight;

ratchet means connected to said wheel and displaceabel between an actuated position for preventing rotation of said wheel in a sense corresponding to dropping of said first counterweight and an unactuated position for allowing rotation of said wheel in said sense;

means engageable with said ratchet means for displacing same into said actuated position only after upward displacement of said second counterweight from a predetermined bottom position through a distance equal to the length of one such tube; and means including a unidirectional clutch for measuring angular displacement of said wheel in a rotational direction opposite said sense.

2. The apparatus defined in claim 1 wherein said means engageable with said ratchet means includes an operating member on said first counterweight for displacing said ratchet means into said unactuated position when said second counterweight descends into said predetermined bottom position and an operating member on said second counterweight for displacing said ratchet means into said actuated position after upward displacement of said second counterweight from said bottom position through said distance.

3. The apparatus defined in claim 2 wherein said ratchet means includes a ratchet pawl engageable with said wheel, a pivotal member having a pair of arms extending into the paths of said counterweights and engageable with the respective operating members thereof, and spring-toggle means defining a pair of stable positions for said ratchet pawl and said pivotal member.

4. The apparatus defined in claim 2 wherein said guide for said second counterweight extends upward past said wheel, said apparatus further comprising means at the upper end of said guide for said second counterweight for locking same in place thereon.

5. The apparatus defined in claim 4 wherein said means for locking includes a pivotal finger member, said second counterweight being formed with a notch, said finger member engageable in said notch.

6. The apparatus defined in claim 2 wherein the measuring means includes a coding wheel.

7. The apparatus defined in claim 6 wherein said measuring means includes a resetting drive for rotating said coding wheel in the rotational direction allowed by said unidirectional clutch.

8. The apparatus defined in claim 2 wherein said second counterweight is provided with an outrigger arm projecting into the path of said anvil and constituting said abutment.

9. The apparatus defined in claim 2 wherein said wheel is a sprocket.

10. The apparatus defined in claim 2 wherein the measuring means includes a recorder and a bowden cable between said recorder and said unidirectional clutch.

* * * * *